US008212498B2

(12) United States Patent
Nerone

(10) Patent No.: US 8,212,498 B2
(45) Date of Patent: Jul. 3, 2012

(54) FLUORESCENT DIMMING BALLAST

(75) Inventor: Louis R. Nerone, Brecksville, OH (US)

(73) Assignee: General Electric Company, Schenectady, NY (US)

( * ) Notice: Subject to any disclaimer, the term of this patent is extended or adjusted under 35 U.S.C. 154(b) by 586 days.

(21) Appl. No.: 12/486,086

(22) Filed: Jun. 17, 2009

(65) Prior Publication Data

US 2010/0213850 A1 Aug. 26, 2010

Related U.S. Application Data

(63) Continuation of application No. 61/154,580, filed on Feb. 23, 2009.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl. ..... 315/299; 315/291; 315/297; 315/301; 315/308

(58) Field of Classification Search ..... None
See application file for complete search history.

(56) References Cited

U.S. PATENT DOCUMENTS

| | | | | |
|---|---|---|---|---|
| 5,162,700 | A | 11/1992 | Soileau | |
| 5,796,214 | A | 8/1998 | Nerone | |
| 5,872,429 | A * | 2/1999 | Xia et al. | 315/194 |
| 5,917,289 | A | 6/1999 | Nerone et al. | |
| 6,078,143 | A | 6/2000 | Nerone | |
| 6,175,195 | B1 | 1/2001 | Janczak et al. | |
| 6,326,740 | B1 | 12/2001 | Chang et al. | |
| 6,417,631 | B1 | 7/2002 | Chen et al. | |
| 6,429,604 | B1 | 8/2002 | Chang | |
| 6,509,696 | B2 | 1/2003 | Bruning et al. | |
| 6,815,908 | B2 | 11/2004 | Glaser et al. | |
| 6,836,077 | B2 | 12/2004 | Nerone | |
| 6,867,553 | B2 | 3/2005 | Nerone et al. | |
| 7,288,901 | B1 * | 10/2007 | Yu et al. | 315/291 |
| 7,414,372 | B2 | 8/2008 | Ribarich | |
| 2005/0184685 | A1 | 8/2005 | Sekine et al. | |

FOREIGN PATENT DOCUMENTS

| | | |
|---|---|---|
| EP | 0 340 049 | 11/1989 |
| EP | 0 479 352 | 4/1992 |

OTHER PUBLICATIONS

International Search Report issued in connection with corresponding PCT Application No. PCT/US2010/021505 on May 18, 2010.

* cited by examiner

*Primary Examiner* — Anh Tran
(74) *Attorney, Agent, or Firm* — Fay Sharpe LLP

(57) ABSTRACT

A dimmable ballast and methods are presented in which the operating frequency of a self-oscillating inverter is controlled according to a sensed lamp current for dimming control or cathode heating, and an AC bus voltage of the inverter is controlled to be at or below a voltage threshold value to prevent over driving operating lamps when one or more lamps are being replaced.

20 Claims, 5 Drawing Sheets

FLUORESCENT DIMMING BALLAST

REFERENCE TO RELATED APPLICATIONS

This application claims priority to and the benefit of U.S. Provisional Patent Application Ser. No. 61/154,580, which was filed Feb. 23, 2009, entitled FLUORESCENT DIMMING BALLAST, the entirety of which application is hereby incorporated by reference. This application relates to U.S. Pat. No. 7,436,124, filed Jan. 31, 2006, entitled VOLTAGE FED INVERTER FOR FLUORESCENT LAMPS to Nerone et al., and to currently pending U.S. patent application Ser. No. 12/040,216 to Nerone et al., filed Feb. 29, 2008 and entitled DIMMABLE INSTANT START BALLAST.

BACKGROUND OF THE DISCLOSURE

Dimmable ballast systems are employed for providing varying levels of light output. Conventional dimming ballasts include multiple discrete ballasts with one or more being selectively shut off to provide a lower light output. This approach, however, cannot achieve continuous dimming and is instead restricted to a finite number of discrete light output levels. This technique is further limited to multiple lamp installations. Conventional continuous dimming approaches operate lamps in series. This technique, however, can lead to premature lamp degradation or failure through undesirable lamp cooling and/or extinguishment. Moreover, this approach suffers from inability to produce light when one or more lamps fail. Another approach has been proposed in which a DC bus amplitude is varied via pulse width modulation (PWM) control to power a voltage or current fed inverter for driving one or more lamps, but this technique adds cost and has only proven feasible to about 10% of the rated lamp current, and thus does not provide the desired amount of dimming for certain applications. Thus, there is a continuing need for improved fluorescent lamp dimming apparatus and techniques for providing cost-effective varying light levels without lamp stress or damage.

SUMMARY OF THE DISCLOSURE

The present disclosure provides simple low cost dimming ballast apparatus and control techniques that may be employed to facilitate dimming operation over a wide range of output levels, down to less than 1% of rated current, without lamp damage and uniform light intensity between lamps in a multiple lamp fixture, producing light while one or more lamps are replaced in a parallel output ballast.

A dimming ballast is disclosed, which includes an input rectifier and a DC-DC converter driving a frequency-controlled self-oscillating inverter which produces an AC signal to power one or more fluorescent lamps. An inverter control system is provided which includes first and second regulators to control the inverter operating frequency in order to adjust the inverter output current and voltage. The first control regulator modifies the inverter operating frequency at least partially based on a sensed lamp current value and a current setpoint value, such as an external dimming control signal. The second regulator adjusts the inverter output according to a voltage setpoint value and a sensed AC bus node voltage value. The ballast can thus be used in multiple-lamp configurations to perform dimming control while accommodating removal of one or more lamps without allowing excess current conditions.

In one embodiment, the inverter provides first and second switching devices coupled in series across a DC input, along with associated drive circuits each including a drive control inductance and a resonance inductance. The inverter in this embodiment also includes a resonant circuit with an inductance that is inductively coupled with the drive circuit inductances and is connected between a center node of the switching devices and an AC bus node so that the drive circuits oscillate for complementary actuation of the first and second switching devices at an inverter operating frequency. The inverter provides an output with one or more ballast capacitances coupled between the AC bus node and the lamp load(s) to drive the lamps in a controlled fashion. The first regulator in this embodiment includes a frequency control inductance inductively coupled with the drive circuit control inductances, and the first regulator selectively varies a loading associated with the first frequency control inductance to modify the drive circuit inductance and thus control the inverter operating frequency so as to adjust the inverter output according to the current setpoint value and the sensed lamp current. The first regulator thus operates in normal dimming mode to regulate the lamp current around the dimming control (current) setpoint. The second regulator also has a (second) frequency control inductance inductively coupled with the drive circuit control inductances, and operates to selectively vary the loading of the second frequency control inductance to control the inverter operating frequency so as to adjust the output of the inverter based on the voltage setpoint value and the sensed AC bus node voltage value. In exemplary embodiments, the second regulator performs voltage regulation to regulate the AC bus node voltage to be at or below a voltage threshold value. This limits the output voltage of the inverter during delamping or when lamps eventually fail.

In some embodiments, the second regulator also includes a cathode heat circuit which selectively heats one or more lamp cathodes and controls the inverter frequency to reduce the output to a predetermined value when the sensed lamp current value is below a threshold value. The cathodes are effectively operated in parallel to maintain a constant voltage.

Certain embodiments of the first regulator include a current setpoint circuit with input terminals to receive a dimming level setpoint signal, as well as a current sense circuit operatively coupled with the inverter to sense a lamp current value and a current regulator that regulates the lamp current according to the dimming level setpoint signal.

A method is provided for powering at least one fluorescent lamp, which includes energizing a self-oscillating inverter to produce an AC signal to power at least one fluorescent lamp, sensing an AC bus node voltage value of the inverter, sensing a lamp current value, receiving a current setpoint value, selectively adjusting the inverter operating frequency to control an output of the inverter based at least partially on the current setpoint value and the sensed lamp current value in a dimming control mode, selectively adjusting the inverter operating frequency to control the output of the inverter to regulate an AC bus node voltage to be at or below a voltage threshold value, and selectively heating one or more lamp cathodes and selectively adjusting the inverter operating frequency to reduce the output of the inverter to a predetermined value when the sensed lamp current value is below a lamp current threshold value.

BRIEF DESCRIPTION OF THE DRAWINGS

One or more exemplary embodiments are set forth in the following detailed description and the drawings, in which.

DETAILED DESCRIPTION OF THE PREFERRED EMBODIMENTS

Figure 1:
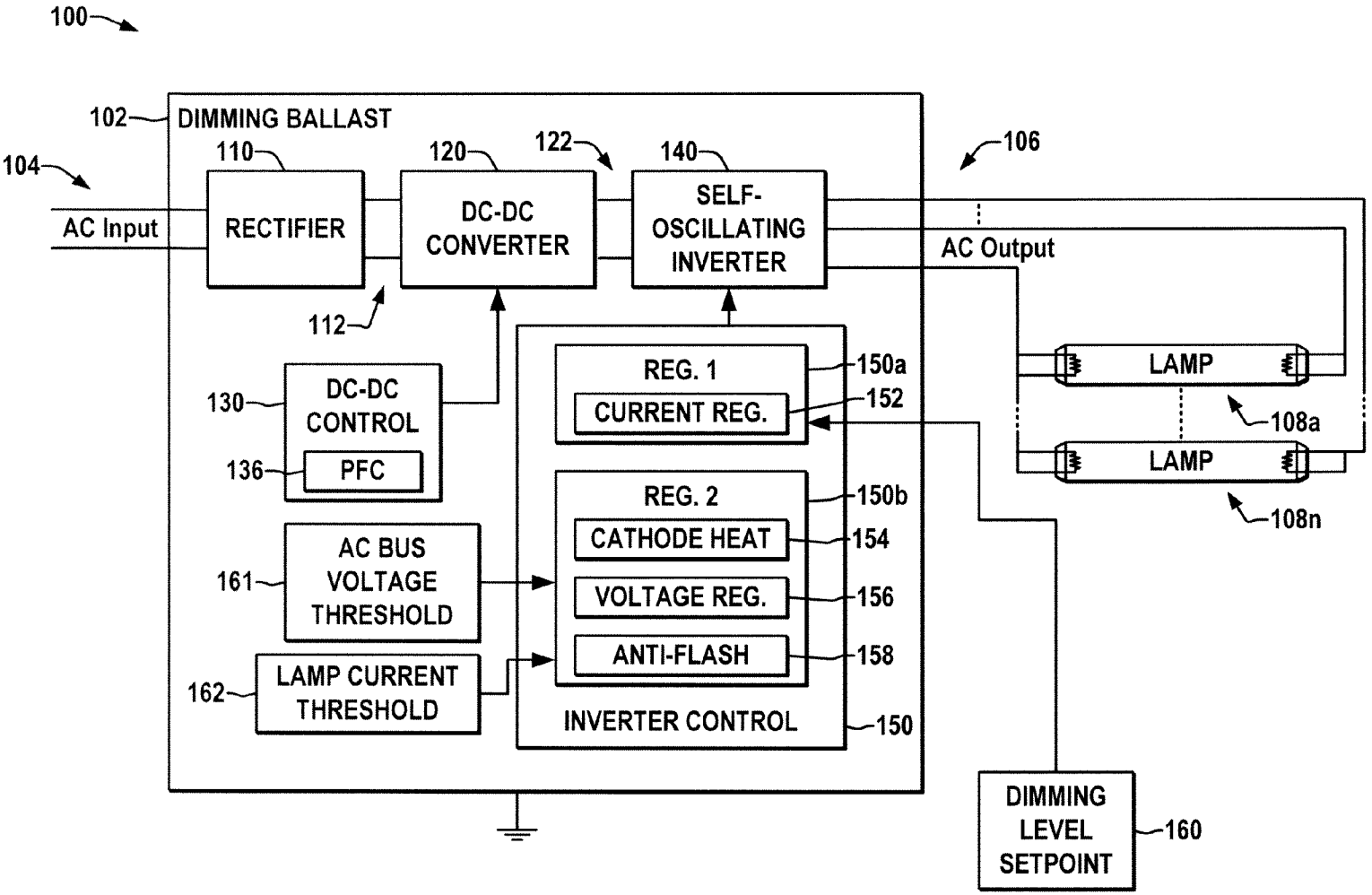
FIG. 1 is a schematic diagram illustrating an exemplary dimming ballast having a self-oscillating inverter with a dual regulator inverter control configuration providing advanced cathode heat, voltage regulation, anti-flash, and current regulation controls.

Referring now to the drawings, where like reference numerals are used to refer to like elements throughout, and wherein the various features are not necessarily drawn to scale, the present disclosure relates to electronic lighting and more particularly to dimming ballasts for use in connection with fluorescent lamps and will be described with particular reference thereto, although the exemplary ballasts described herein can also be used in other lighting applications, and are not limited to the aforementioned application.

FIG. 1 illustrates a dimming ballast 102 in which the operating frequency of a self-oscillating inverter 140 is controlled according to a sensed lamp current for dimming control or cathode heating, and the AC bus voltage of the inverter is controlled so as not to exceed a voltage threshold value in order to prevent over driving operating lamps 108 when one or more lamps 108 are being replaced. The ballast 102 includes a rectifier 110 receiving input power from an AC input 104, where the rectifier can be active or passive or the ballast 102 can alternatively be supplied with DC input power with the rectifier 110 omitted. The rectifier 110 has an output 112 providing a rectified DC voltage to a switching type DC-DC converter 120, which includes various switching devices operated by suitable control signals (not shown). In one embodiment, further illustrated and described in connection with FIG. 2 below, the converter 120 is a boost converter with a controller 130 that can implement power factor control (PFC) component 136 to control the power factor of the ballast 102. The ballast 102 further includes a self-oscillating frequency controlled inverter 140 which receives the DC voltage 122 and provides an AC output 106 to drive one or more lamp loads 108 under control of an inverter controller 150 having first and second control regulators 150*a* and 150*b*. The first regulator 150*a* includes a current regulator 152 to regulate the lamp current at least in part according to a dimming level setpoint 160, such as from an external signal source. The second regulator 150*b* in one embodiment has a cathode heat circuit 154, a voltage regulator 156, and an anti-flash circuit 158, and is operable according to an AC bus voltage threshold 161 for preventing overvoltage situations and according to a lamp current threshold 162 for controlling the lamp cathode heating. One exemplary inverter 140 is further illustrated in FIG. 3 and details of exemplary first and second inverter control regulators are provided in FIGS. 4 and 5. The inverter 140 in certain embodiments may be transformer coupled to provide an isolated AC output 106.

Figure 2:
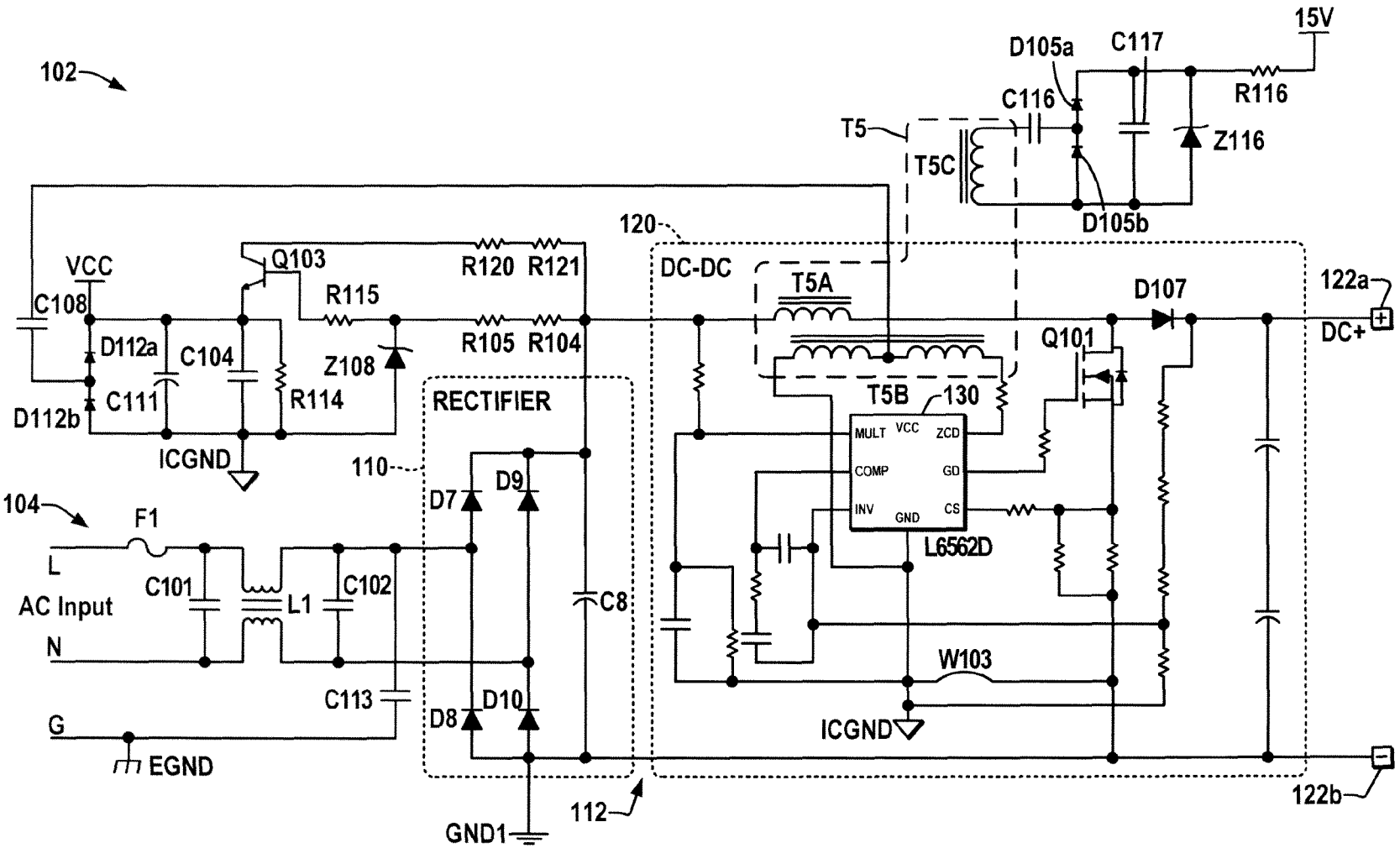
FIG. 2 is a detailed schematic diagram illustrating an exemplary rectifier and boost DC-DC converter in the dimming ballast of FIG. 1.

FIG. 2 illustrates one suitable embodiment of a rectifier 110 and boost DC-DC converter 120 that may be used in the dimming ballast 102. The rectifier 110 receives input AC power from line and neutral connections L and N of the input 104, respectively, and includes an earth ground connection G for connection to a ground EGND and a line-ground capacitor C113, and the input 104 may include various additional components, such as capacitors C101 and an inductor L1. The rectifier 110 provides a full wave diode bridge including diodes D7-D9 and an output filter capacitor C8 to provide an initial DC output 112 that is received as an input to the DC-Dc converter 120. An integrated circuit DC voltage VCC is provided relative to a circuit ground ICGND in this embodiment via a shunt regulator circuit including a 15 volt zener diode Z108, a bipolar transistor Q103 and resistors R104, R105, R114, R115, R120, and R121, as well as output capacitors C104 and C111. The center of a transformer winding T5B is capacitively coupled via capacitor C108 to a center of the VCC supply using diodes D112*a* and D112*b*. The exemplary DC-DC converter 120 is a boost converter receiving the initial DC output 112 and selectively switching a FET Q101 according to signals from a controller 130 to provide a second DC output at terminals 122*a* and 122*b* for driving the inverter 140. The converter 120 includes a boost converter inductance T5A having tertiary control winding T5B connected to the controller 130, as well as a secondary winding T5C used for establishing a circuit voltage 15V using a 15 V zener Z115, capacitors C116 and C117, diodes D105*a* and D105*b* and a resistor R116.

Figure 3:
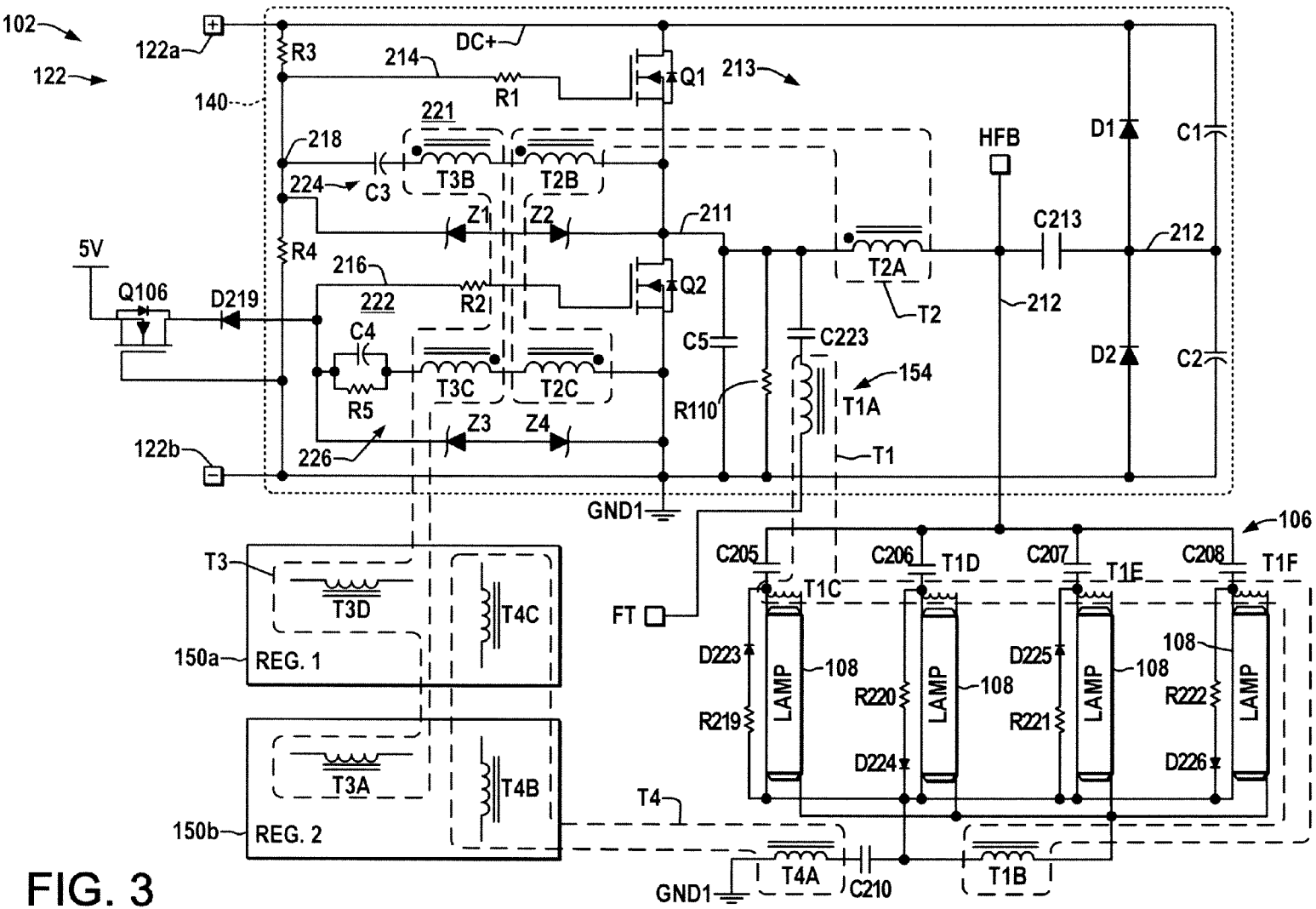
FIG. 3 is a detailed schematic diagram illustrating an exemplary self-oscillating inverter driving one or more parallel-connected fluorescent lamps in the ballast of FIGS. 1 and 2.

FIG. 3 illustrates further details of an exemplary self-oscillating inverter 140 coupled with the DC terminals 122*a* and 122*b* that receive DC power from the boost converter 120. The inverter 140 includes a resonant circuit 213 and a pair of controlled switching devices Q1 and Q2, in one example, n-type MOSFETs although any suitable switching devices may be employed. The input DC received at terminals 122*a* and 122*b* is selectively switched by Q1 and Q2 coupled in series between a positive voltage node DC+ and a negative node coupled to a first circuit ground GND1, where this selective switching of Q1 and Q2 operates to generate a square wave at an inverter output node 211, which in turn excites the resonant circuit 213 to thereby drive a high frequency bus at node 212 (HFB).

The inverter 140 includes transformers T2-T4 for output power sensing and control for self-oscillation with adjustable inverter operating frequency, as well as a transformer T1 for cathode heating operation.

Transformer T2 has a first winding T2A in series between the inverter output 211 and the HFB 212 along with windings T2B and T2C in switch drive control circuits 221 and 222 associated with the switching devices Q1 and Q2, respectively. In operation of the inverter 140, the winding T2A acts as a primary in the resonant circuit 213 and the secondary windings T2B and T2C are connected in the gate drive circuits for Q1 and Q2, respectively for oscillatory actuation of the switches according to the resonance of the circuit 213.

The transformer T3 has a first winding T3A operative as a frequency control inductance in the second regulator 150*b* and windings T3B and T3C in the switch control circuits 221 and 222, where each drive control circuit 221, 222 includes a series combination of windings from T2 and T3. The third transformer T3 is used by the controller 150 to selectively control the inductance of the gate drive circuits 221 and 222 and thus to control the inverter operating frequency for closed loop operation of the inverter 140 to control the amount of power delivered to the lamps 108 at the output 106.

AC power from the high frequency bus 212 provides an AC output 106 used to drive one or more lamp loads 108 (four lamps 108 shown in the illustrated example of FIG. 3) via corresponding ballasting capacitors C205-C208, where any number of lamps 108 can be thus coupled with the high frequency bus 212. The exemplary output 106 may also include additional circuitry, such as resistors R219-R222, diodes D223-D226, and blocking capacitor C210 for striation control.

A transformer T1 is provided to implement selective heating for lamp cathodes, including a primary winding T1A coupled to the inverter output 211 via a capacitor C223 and coupled via a node FT to a cathode heat circuit 154 (FIG. 5 below) for selective actuation when the lamp current is below a threshold 162. The transformer T1 includes secondary windings T1C, T1D, T1E, and T1F for heating individual upper lamp cathodes as well as a common secondary T1B to which all the lower cathodes are coupled for heating. The lower common lamp terminals are coupled to GND1 through capacitor 210 and a primary winding T4A of transformer T4, having secondaries T4C and T4B in the first and second regulators 156*a* and 156*b*, respectively.

The high frequency bus is generated at the node 212 by the inverter 140 and the resonant circuit 213, which includes a resonant inductance T2A as well as an equivalent resonant capacitance including the equivalent of capacitors C1 and C2 connected in series between the DC+ and GND1 nodes, with a center node coupled to the bus 212 via capacitor 213. A clamping circuit is formed by diodes D1 and D2 individually coupled in parallel with the capacitances C1 and C2, respectively. The switches Q1 and Q2 are alternately activated to provide a square wave of amplitude VDC/2 at the common inverter output node 211 (e.g., half the DC bus voltage across the terminals 122*a* and 122*b*), and this square wave inverter output excites the resonant circuit 213. Gate or control lines 214 and 216 include resistances R1 and R2 to provide control signals to the control terminals of Q1 and Q2, respectively.

The switch gating signals are generated using the drive circuits 221 and 222, with the first drive circuit 221 coupled between the inverter output node 211 and a first circuit node 218, and the second drive circuit 222 coupled between the circuit ground GND1 and node 216. The drive circuits 221 and 222 include the first and second driving inductors T2B and T2C or transformer T2, which are secondary windings mutually coupled to the resonant inductor T2A of the resonant circuit 213 to induce voltage in the driving inductors T2B and T2C proportional to the instantaneous rate of change of current in the resonant circuit 213 for self-oscillatory operation of the inverter 140. In addition, the drive circuits 221 and 222 include the secondary inductors T3B and T3C serially connected to the respective first and second driving inductors T2B and T2C and the gate control lines 214 and 216. The windings T3B and T3C operate as drive control inductances with the inverter control regulators 150*a* and 150*b* each having tertiary frequency control inductance windings (T3D and T3A, respectively) by which the controller 150 can change the oscillatory frequency of the inverter 140 by varying the inductance of the windings T3B and T3C through control of the current through the frequency control inductance(s).

In operation, the gate drive circuits 221 and 222 maintain Q1 in an "ON" state for a first half of a cycle and the switch Q2 "ON" for a second half of the cycle to generate a generally square wave at the output node 211 for excitation of the resonant circuit 213. The gate to source voltages Vgs of the switching devices Q1 and Q2 in one embodiment are limited by bi-directional voltage clamps Z1, Z2 and Z3, Z4 (e.g., back-to-back Zener diodes) coupled between the respective switch sources and the gate control lines 214 and 216. In this embodiment, the individual bi-directional voltage clamp Z1, Z2 and Z3, Z4 cooperate with the respective inductor T3B and T3C to control the phase angle between the fundamental frequency component of voltage across the resonant circuit 213 and the AC current in the resonant inductor T2A.

To start the inverter 140, series coupled resistors R3 and R4 across the input terminals 122*a* and 122*b* cooperate with a resistor R110 (coupled between the inverter output node 211 and the circuit GND1) to initiate regenerative operation of the gate drive circuits 221 and 222. The inverter switch control circuitry further includes capacitors C3 and C4 coupled in series with the windings T3B and T3C, respectively. When DC power is initially provided to the inverter 140, C3 is charged from the positive DC input 122*a* via R3, R4 and R110, while a resistor R5 shunts the capacitor C4 in the drive circuit 222 to prevent C4 from charging and thereby prevents concurrent activation of Q1 and Q2. Since the voltage across C3 is initially zero, the series combination of T2B and T3B acts as a short circuit due to a relatively long time constant for charging of the capacitor C3. Once C3 charges up to the threshold voltage of the Vgs of Q1, (e.g., 2-3 volts in one embodiment), Q1 turns ON and a small bias current flows through Q1. This current biases Q1 in a common drain, Class A amplifier configuration having sufficient gain to allow the combination of the resonant circuit 213 and the gate control circuit 221 to produce a regenerative action to begin oscillation of the inverter 140 at or near the resonant frequency of the network including C3, T3B, and T2B, which is above the natural resonant frequency of the resonant circuit 213. As a result, the resonant voltage seen at the high frequency bus node 212 lags the fundamental of the inverter output voltage at node 211, thereby facilitating soft-switching operation of the inverter 140. The inverter 140 therefore begins operation in a linear mode at startup and transitions into switching Class D mode. The inverter will not start up until the 5V power supply reaches at least the threshold of the depletion mode MOSFET Q106. When this happens, the voltage at the gate of Q2 rises and allows the inverter 140 to begin oscillating.

In steady state operation of the ballast 102, the square wave voltage at the inverter output node 211 has an amplitude of approximately one-half of the voltage of the positive terminal 122*a* (e.g., Vdc/2), and the initial bias voltage across C3 drops. In the illustrated inverter a first network 224 including the capacitor C3 and inductor T3B and a second network 226 including the capacitor C4 and inductor T3C are equivalently inductive with an operating frequency above the resonant frequency of the first and second networks 224, 226. In steady state oscillatory operation, this results in a phase shift of the gate circuit to allow the current flowing through the inductor T2A to lag the fundamental frequency of the voltage produced at the inverter output node 211, thus facilitating steady-state soft-switching of the inverter 140. The output voltage of the inverter 140 in one embodiment is clamped by the serially connected clamping diodes D1 and D2 to limit high voltage seen by the resonant circuit capacitors C1 and C2. As the inverter output voltage at node 211 increases, the clamping diodes D1, D2 start to clamp, preventing the voltage across the capacitors C1 and C2 from changing sign and limiting the output voltage to a value that prevents thermal damage to components of the inverter 140.

The controller 150 senses the output load current signal sensed by the primary winding T4A to perform various control functions to regulate the lamp current by varying the inductances of the inverter windings T3B and T3C, and hence the operating frequency of the inverter 140, by changing the loading seen by one or both of the tertiary windings T3A and T3D. In the illustrated inverter 140, as the operating frequency decreases, the output current increases, and vice versa. The inverter frequency, moreover, decreases with decreased loading of either T3A or T3D. Thus, the control regulators 150*a* and/or 150*b* (FIGS. 4 and 5 below) increase or decrease the loading on T3D and/or T3A to reduce or raise the lamp current, respectively.

Figure 4:
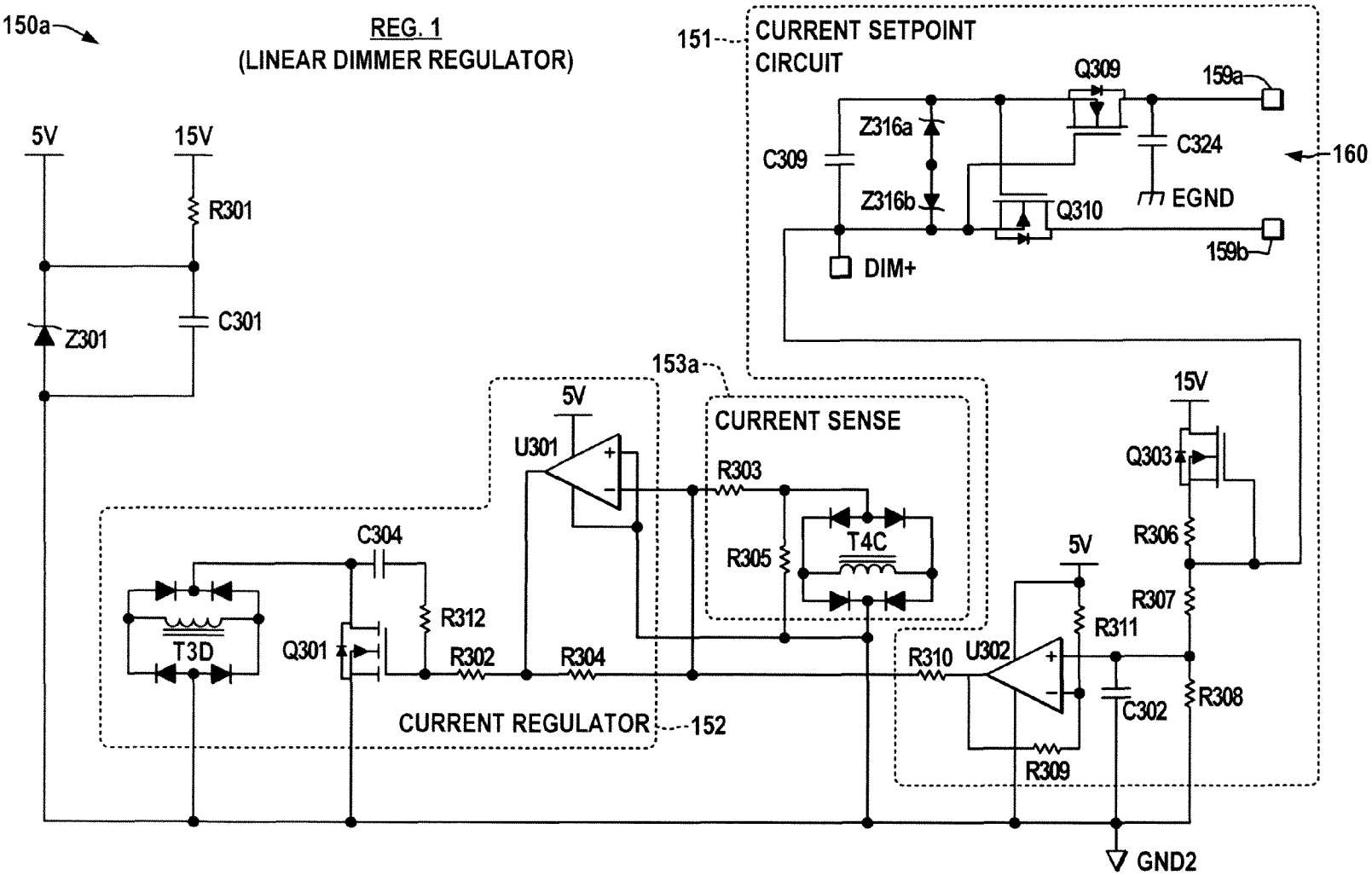
FIGS. 4 and 5 are detailed schematic diagrams illustrating exemplary first and second regulators for controlling the inverter in the ballast of FIGS. 1-3.

FIG. 4 illustrates one embodiment of a first regulator, in this case a linear dimmer regulator 150*a* in the inverter controller 150. In operation, the first regulator 150*a* selectively varies a loading associated with the first frequency control inductance (T3D) to control the inverter operating frequency to adjust the inverter output 106 based at least in part on a sensed lamp current value and on a current setpoint value 160, which can be an internal preset or an external dimming level setpoint signal (e.g., 0-10 volts DC in one example) received at terminals 159*a* and 159*b* of a current setpoint circuit 151. The current setpoint circuit in one embodiment includes a miswiring protection circuit comprised of cross-coupled MOSFETs Q309 and 310 as well as series connected zener diodes Z316*a* and Z316*b* and capacitor C309 to prevent device damage if the dimming control terminals 159 are inadvertently connected to high voltage lines, and the protection circuit provides a dimming signal at the node DIM+ of 0-10 volts in one embodiment, representing a desired lamp current in a predefined operating range. The protection MOSFETs Q309 and Q310 are depletion mode devices which maintain on-state operation until their gate to source voltages are brought to a negative value, such as about −2.5V in one embodiment, thereby allowing the devices Q309 and Q310 to remain on when no voltage is applied to the control input terminals 159*a* and 159*b*. The current setpoint signal 160 is scaled and buffered via circuitry including a depletion mode n-channel MOSFET Q303, amplifier U302, resistors R306-R311 and capacitor C302 to present a signal representing the setpoint value to the summing node at the inverting input of U301.

U301 of the current regulator circuit 152 compares the setpoint with the sensed lamp current value to control switch Q301 via resistors R304, R302, and R312 and capacitor C304 to control the loading of the first frequency control inductance T3D, where fully shorting the rectifier connected to T3D (Q301 fully ON) loads the winding T3D and thus lowers the inverter output 106. In closed loop fashion, the current regulator 152 selectively varies the loading of the frequency control inductance T3D to control the inverter operating frequency to regulate the lamp current according to the dimming level setpoint signal 160 to achieve dimmer control operation of the ballast 102, where increasing the loading of T3D (e.g., by increasing the gating signal to Q301) decreases the inductance of the transformer windings T3B and T3C and thereby increases the inverter frequency and decreases the output lamp current when the sensed lamp current level is above the setpoint value, and vice versa when the sensed lamp current level is below the setpoint 160. The current regulator 152 thus operates to selectively vary the loading of the frequency control inductance T3D to control the inverter operating frequency to regulate the lamp current according to the dimming level setpoint signal 160. The exemplary second regulator 150*a*, moreover, is referenced to a second ground GND2, where the DC supply voltage 5V for U301 and U302 is established using current from the 15V supply via a 5 volt zener Z301, resistor R301, and capacitor C301.

Figure 5:
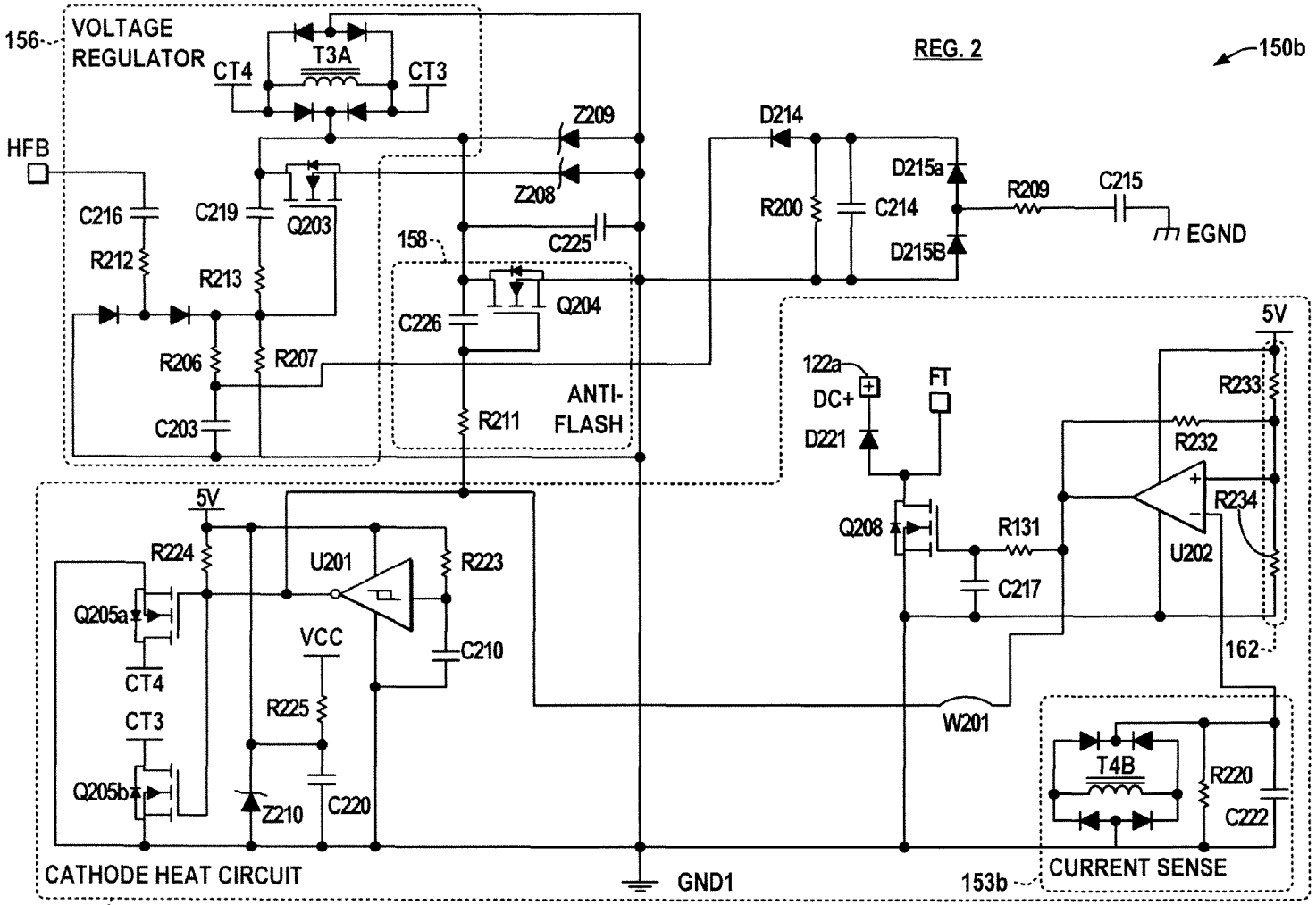

Referring also to FIG. 5, in addition to steady-state dimming control via the first regulator 150*a*, the controller 150 also provides a second regulator 150*b* operable to selectively adjust the inverter operating frequency to control the inverter output to regulate the voltage at the high frequency AC bus node 212 to be at or below a voltage threshold value 161 for over-voltage protection while lamps 108 are being replaced or otherwise are removed from the output 106. The second regulator 150*b* also selectively heats one or more lamp cathodes and reduces the inverter output to a predetermined value when the sensed lamp current value is below a lamp current threshold value 162.

The second regulator 150*b* in the embodiment of FIG. 5 includes a voltage regulator 156 operative to selectively vary the loading of T3A to control the inverter operating frequency to regulate the AC bus voltage at node 212 to be at or below a voltage threshold value 161. The voltage regulator 156 senses the HFB voltage via resistor R212 capacitively coupled to the bus node 212 by capacitor C216 to control a gate of an n-channel enhancement mode control MOSFET Q203. The gate signal to Q203 is delayed on startup by a time constant set by R206, R207, and C203 so that voltage regulator 156 does not begin to control the inverter 140 until initial preheating is completed. Zener Z209 (33 volts in one embodiment) and a capacitor C225 clamp the voltage at the drain of Q203 relative to GND1 and another zener Z208 (e.g., 7.5 volt) claims the MOSFET source. The regulator 156 includes resistor R213 and capacitor C219 connected in series between the gate and source of Q203. The second frequency control inductance T3A is connected to a four-diode rectifier and to terminals CT3 and CT4 of the cathode heat circuit 154 described below.

The resistors R213 and R207 establish a bias point for operation of the voltage regulation such that higher bus voltages cause Q203 to increase the loading on T3A thereby increasing the inverter frequency to lower the output power, whereby the high frequency bus voltage at node 212 will not exceed a predetermined threshold 161 set by the bias point. In operation, when an end user removes one or more lamps 108 or if a lamp 108 fails and the normal current control of the first regulator 150*a* drives the inverter 140 to the setpoint total output current level, the voltage regulator 156 takes over once the sensed HFB voltage has risen too far, and will regulate the bus voltage to be at or below a voltage threshold value 161. When the user thereafter replaces the lamp(s) 108, the first rectifier 150*a* can then resume steady-state current regulation around the dimming level setpoint value 160 after another preheat cycle.

Voltage regulator 156 also includes an anti-flash circuit 158 integrator including MOSFET Q204, capacitor C226, and resistor R211 which operates to delay the transition after preheating so as to allow C226 to slowly charge up if the dimming setpoint value 160 is low. In operation, this allows the voltage regulator 156 to start regulating at a lower bus voltage until the voltage across C226 gradually increases to a steady level.

Referring now to FIGS. 3 and 5, the second regulator 150*b* of FIG. 5 also includes a cathode heat circuit 154 which operates to selectively heat one or more of the lamp cathodes when a sensed lamp current value is below a lamp current threshold value 162. A current sense circuit 153*b* senses the lamp current via rectifier-connected secondary winding T4B, resistor R220 and capacitor C222 to provide a sensed current signal to an inverting input of an op-amp U202, with the non-inverting input of U202 being biased at a lamp current threshold value 162 set by resistors R233 and R234. The error signal is amplified via U202 and gain resistor R232 and filtered by resistor R131 and capacitor C217 to drive the gate terminal of a MOSFET Q208 having a drain coupled to the cathode heat transformer primary winding T1A at a cathode heat control terminal FT (FIG. 3), which is also coupled to the DC+ voltage by diode D221. When the sensed current value from T4B is below the lamp current threshold 162, Q208 turns on, thereby energizing the cathode heat control primary winding T1A. This causes heating currents to flow in the secondary windings T1B-T1F (FIG. 3) to heat the cathodes of the lamps 108. In one embodiment, the threshold 162 is set such that lamp currents below about 140 mA will cause the cathode heat circuit 154 to enter the heating mode for energizing the transformer T1.

The heating mode in the illustrated embodiment continues for a pre-determined time period set by a one-shot circuit formed by a Schmidt trigger U201, resistor R223, and capacitor C210, which is powered by a 5.3 volt zener circuit including zener Z210, capacitor C220 and resistor R225. The output of the one-shot trigger U201 is coupled to the output of U202 to end the heating activation of T1 after this preset time period. The one-shot signal output is pulled up to the 5V supply via resistor R224 and also activates MOSFET pair Q205*a*, Q205*b* for selectively shorting the frequency control inductance T3A during the heating period via terminals CT3 and CT4. In this manner, the cathode heat circuit 154 also varies the loading of T3A to reduce the inverter output to a predetermined low value when the sensed lamp current value is below the lamp current threshold value 162 during cathode heating.

The disclosed techniques further provide a method of powering one or more fluorescent lamps, which includes energizing a self-oscillating inverter 140 to produce an AC signal 212 to power at least one fluorescent lamp 108, sensing an AC bus node voltage value of the inverter 140, sensing a lamp current value, receiving a current setpoint value 160, selectively adjusting the inverter operating frequency to control an output of the inverter 140 based at least partially on the current setpoint value 160 and the sensed lamp current value in a dimming control mode, selectively adjusting the inverter operating frequency to control the output of the inverter 140 to regulate an AC bus node voltage (HFB) to be at or below a voltage threshold value 161, and selectively heating one or more lamp cathodes and selectively adjusting the inverter operating frequency to reduce the output of the inverter 140 to a predetermined value when the sensed lamp current value is below a lamp current threshold value 162.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the term "comprising". The invention has been described with reference to the preferred embodiments. Obviously, modifications and alterations will occur to others upon reading and understanding the preceding detailed description. It is intended that the invention be construed as including all such modifications and alterations.

The following is claimed:

1. A dimming ballast for operating at least one fluorescent lamp, the ballast comprising:

an input rectifier operative to receive an AC input and to produce an initial DC output;

a DC-DC converter operatively coupled to the input rectifier to receive the initial DC output and to provide a second DC output;

a frequency-controlled self-oscillating inverter operatively coupled to DC-DC converter to convert the second DC output to produce an AC signal to power at least one fluorescent lamp; and an inverter control system operatively coupled with the inverter to control the inverter operating frequency, the inverter control system including:

a first regulator operative to selectively vary the inverter operating frequency to adjust an output of the inverter based at least partially on a current setpoint value and a sensed lamp current value, and a second regulator operative to selectively vary the inverter operating frequency to adjust the output of the inverter based at least partially on a voltage setpoint value and a sensed AC bus node voltage value.

2. The dimming ballast of claim 1:

where the inverter comprises:

a first switching device having a control terminal coupled with a first drive circuit, the first drive circuit including a first drive control inductance and a first resonance inductance, a second switching device having a control terminal coupled with a second drive circuit the second drive circuit including a second drive control inductance and a second resonance inductance, the first and second switching devices being coupled in series across the second DC output, a resonant circuit including a resonant inductance operatively coupled between a center node of the switching devices and an AC bus node, the resonant inductance being inductively coupled with the first and second resonance inductances to cause the first and second drive circuits to oscillate for complementary actuation of the first and second switching devices at an inverter operating frequency, and an output including at least one ballast capacitance coupled between the AC bus node and at least one fluorescent lamp;

where the first regulator comprises a first frequency control inductance inductively coupled with the first and second drive control inductances of the drive circuits, the first regulator operative to selectively vary a loading associated with the first frequency control inductance to control the inverter operating frequency to adjust the output of the inverter based at least partially on the current setpoint value and the sensed lamp current value; and where the second regulator comprises a second frequency control inductance inductively coupled with the first and second drive control inductances of the drive circuits, the second regulator operative to selectively vary a loading associated with the second frequency control inductance to control the inverter operating frequency to adjust the output of the inverter based at least partially on the voltage setpoint value and the sensed AC bus node voltage value.

3. The dimming ballast of claim 2, where the second regulator comprises a voltage regulator operative to selectively vary the loading associated with the second frequency control inductance to control the inverter operating frequency to regulate the AC bus node voltage to be at or below a voltage threshold value.

4. The dimming ballast of claim 3, where the second regulator further comprises a cathode heating circuit operative to selectively heat one or more lamp cathodes when a sensed lamp current value is below a lamp current threshold value.

5. The dimming ballast of claim 4, where the cathode heating circuit is further operative to selectively vary the loading associated with the second frequency control inductance to control the inverter operating frequency to reduce the output of the inverter to a predetermined value when the sensed lamp current value is below the lamp current threshold value.

6. The dimming ballast of claim 5, where the first regulator comprises:

a current setpoint circuit with input terminals to receive a dimming level setpoint signal;

a current sense circuit operatively coupled with the inverter to sense a lamp current value; and a current regulator operative to selectively vary a loading associated with the first frequency control inductance to control the inverter operating frequency to regulate the lamp current according to the dimming level setpoint signal.

7. The dimming ballast of claim 4, where the first regulator comprises:

a current setpoint circuit with input terminals to receive a dimming level setpoint signal;

a current sense circuit operatively coupled with the inverter to sense a lamp current value; and a current regulator operative to selectively vary a loading associated with the first frequency control inductance to control the inverter operating frequency to regulate the lamp current according to the dimming level setpoint signal.

8. The dimming ballast of claim 3, where the first regulator comprises:

a current setpoint circuit with input terminals to receive a dimming level setpoint signal;

a current sense circuit operatively coupled with the inverter to sense a lamp current value; and a current regulator operative to selectively vary a loading associated with the first frequency control inductance to control the inverter operating frequency to regulate the lamp current according to the dimming level setpoint signal.

9. The dimming ballast of claim 2, where the second regulator further comprises a cathode heating circuit operative to selectively heat one or more lamp cathodes when a sensed lamp current value is below a lamp current threshold value.

10. The dimming ballast of claim 9, where the cathode heating circuit is further operative to selectively vary the loading associated with the second frequency control inductance to control the inverter operating frequency to reduce the output of the inverter to a predetermined value when the sensed lamp current value is below the lamp current threshold value.

11. The dimming ballast of claim 10, where the first regulator comprises:

a current setpoint circuit with input terminals to receive a dimming level setpoint signal;

a current sense circuit operatively coupled with the inverter to sense a lamp current value; and a current regulator operative to selectively vary a loading associated with the first frequency control inductance to control the inverter operating frequency to regulate the lamp current according to the dimming level setpoint signal.

12. The dimming ballast of claim 9, where the first regulator comprises:

a current setpoint circuit with input terminals to receive a dimming level setpoint signal;

a current sense circuit operatively coupled with the inverter to sense a lamp current value; and a current regulator operative to selectively vary a loading associated with the first frequency control inductance to control the inverter operating frequency to regulate the lamp current according to the dimming level setpoint signal.

13. The dimming ballast of claim 1, where the second regulator further comprises a cathode heating circuit operative to selectively heat one or more lamp cathodes when a sensed lamp current value is below a lamp current threshold value.

14. The dimming ballast of claim 13, where the first regulator comprises:

a current setpoint circuit with input terminals to receive a dimming level setpoint signal;

a current sense circuit operatively coupled with the inverter to sense a lamp current value; and a current regulator operative to selectively control the inverter operating frequency to regulate the lamp current according to the dimming level setpoint signal.

15. The dimming ballast of claim 14, where the second regulator comprises a voltage regulator operative to selectively control the inverter operating frequency to regulate the AC bus node voltage to be at or below a voltage threshold value.

16. The dimming ballast of claim 13, where the second regulator comprises a voltage regulator operative to selectively control the inverter operating frequency to regulate the AC bus node voltage to be at or below a voltage threshold value.

17. The dimming ballast of claim 1, where the second regulator comprises a voltage regulator operative to selectively control the inverter operating frequency to regulate the AC bus node voltage to be at or below a voltage threshold value.

18. The dimming ballast of claim 17, where the first regulator comprises:

a current setpoint circuit with input terminals to receive a dimming level setpoint signal;

a current sense circuit operatively coupled with the inverter to sense a lamp current value; and a current regulator operative to selectively control the inverter operating frequency to regulate the lamp current according to the dimming level setpoint signal.

19. The dimming ballast of claim 1, where the first regulator comprises:

a current setpoint circuit with input terminals to receive a dimming level setpoint signal;

a current sense circuit operatively coupled with the inverter to sense a lamp current value; and a current regulator operative to selectively control the inverter operating frequency to regulate the lamp current according to the dimming level setpoint signal.

20. A method of powering at least one fluorescent lamp, the method comprising:

energizing a self-oscillating inverter to produce an AC signal to power at least one fluorescent lamp;

sensing an AC bus node voltage value of the inverter;

sensing a lamp current value;

receiving a current setpoint value;

selectively adjusting the inverter operating frequency to control an output of the inverter based at least partially on the current setpoint value and the sensed lamp current value in a dimming control mode;

selectively adjusting the inverter operating frequency to control the output of the inverter to regulate an AC bus node voltage to be at or below a voltage threshold value; and selectively heating one or more lamp cathodes and selectively adjusting the inverter operating frequency to reduce the output of the inverter to a predetermined value when the sensed lamp current value is below a lamp current threshold value.

* * * * *